United States Patent [19]

Harrsch

[11] 4,156,358

[45] May 29, 1979

[54] DRUM FOR THE WET TREATMENT OF MATERIALS

[75] Inventor: Ernst Harrsch, Marbach, Fed. Rep. of Germany

[73] Assignee: Firma Gebr. Poensgen & Sulzmann GmbH, Steinheim, Fed. Rep. of Germany

[21] Appl. No.: 855,387

[22] Filed: Nov. 28, 1977

[51] Int. Cl.[2] ..... D06F 21/04; D06F 37/06

[52] U.S. Cl. ..... 68/27; 68/142; 68/210

[58] Field of Search ..... 68/27, 58, 142, 143, 68/210

[56] References Cited

FOREIGN PATENT DOCUMENTS

| | | | |
|---|---|---|---|
| 7307294 | 2/1973 | Fed. Rep. of Germany. | |
| 2345943 | 4/1975 | Fed. Rep. of Germany. | |
| 2606350 | 9/1976 | Fed. Rep. of Germany | 68/27 |
| 1275056 | 9/1961 | France | 68/58 |

*Primary Examiner*—Philip R. Coe

*Attorney, Agent, or Firm*—Spencer & Kaye

[57] ABSTRACT

A drum-equipped apparatus for the wet treatment of batches of material has a horizontally oriented rotatably supported drum including a drum shell bounded by end walls and including a central inlet opening and a central outlet opening provided in the one and the other end wall, respectively. The apparatus further has a drive for selectively rotating the drum in a treating direction and in an opposite, conveying direction. A lifting wall is secured to the drum in the inside thereof for displacing the material batch radially with respect to the rotary axis of the drum during the rotation thereof in the treating direction. Further, a slide is secured to the drum in the inside thereof for displacing the material batch in the axial direction of the drum towards the outlet opening during the rotation thereof in the conveying direction. The drum is supported in an external vessel which receives treating liquid into which the drum is partially submerged. The drum shell has an apertured zone oriented towards the slide face of the slide and an aperture-free zone oriented towards the reverse side of the slide.

9 Claims, 8 Drawing Figures

DRUM FOR THE WET TREATMENT OF MATERIALS

BACKGROUND OF THE INVENTION

This invention relates to a drum-equipped apparatus for the batch-wise wet treatment of textiles, particularly a washing machine. The apparatus includes a horizontally oriented, driven drum which has central inlet and outlet openings in the end walls and further has an internal conveying impeller. The latter is provided with a lifting wall for the radial displacement of the batch during the rotation of the impeller in the "treating direction" and a slide for the axial discharge of the batch during the rotation of the impeller in the opposite, "conveying direction". The drum is supported in stationary external vessel and is partially submerged in the treating liquid contained in the vessel.

German Laid-Open Application (Offenlegungsschrift) No. 23 45 943 discloses a continuous washing machine for laundry batches. The drum of the washing machine is formed of axially juxtapositioned length portions which, in turn, are supported in respective outer chambers (also arranged serially) each containing the wash liquid. The end walls of the drum length portions projecting radially beyond the abutment faces of the length portions extend into annular spaces of the outer chambers adjoining the abutment faces. Between the end wall of the drum length portion and the annular chamber wall there is provided a sliding seal for separating the adjacent wash baths from one another. Such sliding seals are, however, continuously exposed to mechanical wear as well as chemical and thermal effects of the wash liquid so that a loss of a satisfactory seal and resulting leaks are likely to occur. Such leaks, in turn, lead to an undesirable mixing of the wash baths, particularly during longer periods of standstill (at night or over weakends). Thus, a satisfactory and safe wash zone separation cannot be ensured. Although the drum has apertures only along three-fourths of its circumference, the non-apertured zone, nevertheless, is situated at the location where the lifting wall of the conveying impeller joins the drum surface and thus it has no effect on the guidance of the wash liquid and the laundry batch.

German Utility Model Patent (Gebrauchsmuster) No. 73 07 294 discloses a continuous washing machine for laundry loads which has a drum provided with apertures only in certain zones of the drum. The aperture zones are connected with one another by a channel-like, sealed hollow space at the outer side of the drum. This arrangement seeks to achieve that the washing liquid contained in the hollow space remains, during the conveying phase, in the respective chamber and thus does not flow with the laundry load into the successive chamber. Since this arrangement is a single-drum apparatus, whose radially closed drum accommodates laundry and washing liquid, it is, to be sure, possible to achieve a full separation of the individual wash baths by the internal radial separating walls. A separate control of the individual baths, however, such as control of temperature, concentration of wash detergent and additives can be effected only with difficulty and in a time consuming manner. Thus, the washing process cannot be adapted to non-homogeneous laundry in an optimal manner.

SUMMARY OF THE INVENTION

It is an object of the invention to provide an improved drum for an apparatus of the above-outlined type to ensure in a reliable manner the full separation of the wash baths from one another even in case of lengthy idle periods and to further ensure that each wash bath can be readily controlled and altered.

This object and others to become apparent as the specification progresses, are accomplished by the invention, according to which, briefly stated, the drum-equipped apparatus for the wet treatment of batches of material has a horizontally oriented, rotatably supported drum including a drum shell bounded by end walls and including a central inlet opening and a central outlet opening provided in the one and the other end wall, respectively. The apparatus further has a drive for selectively rotating the drum in a treating direction and in an opposite, conveying direction. A lifting wall is secured to the drum in the inside thereof for displacing the material batch radially with respect to the rotary axis of the drum during the rotation thereof in the treating direction. Further, a slide is secured to the drum in the inside thereof for displacing the material batch in the axial direction of the drum towards the outlet opening during the rotation thereof in the conveying direction. The drum is supported in an external vessel which receives treating liquid into which the drum is partially submerged. The drum shell has an apertured zone oriented towards the slide face of the slide and an aperture-free zone oriented towards the reverse side of the slide.

According to a particularly advantageous feature of the invention, the length of the non-apertured (aperture-free) zone in the circumferential direction is such that in the submerged state of the aperture-free zone, both ends thereof are above the liquid level.

The invention is particularly advantageous in that the drum shell provided with an apertured zone and an aperture-free zone of predetermined magnitude and circumferential orientation, there is obtained, in a certain angular position of the drum, an outwardly closed space into which no liquid can penetrate from the outside even during extended idle periods and further, liquids can also not flow from the inside outwardly. During the treating operation, on the other hand, the liquid may normally flow in either direction (inwardly and outwardly). Since the aperture-free zone of the drum shell is smooth and therefore has favorable sliding properties, there is obtained a substantial conveying component for the batches; this circumstance, in turn, results in a forceful liquid penetration with a vigorous treating effect. The liquid penetration is further amplified by the division of the apertured and the non-apertured zones in the drum shell, resulting in a practically forced guidance in certain angular positions of the drum. Further, during the rotation of the drum in the "conveying direction", the batch is first lumped together as a whole and then conveyed again as a whole. In this manner, the parts forming the batch always remain together and leave the apparatus in the same composition as they entered it.

With a drum-equipped apparatus, particularly a washing machine, having a drum structured according to the invention, there is thus achieved not only a continuous and absolute bath separation (including a biological bath separation, so that no recontamination is possible), but also, due to the mechanical conveyance of the articles in a single direction of drum rotation, there is achieved an intensive, yet gentle handling and it is further ensured that the bath separation is securely maintained even during the conveying phase.

DESCRIPTION OF THE PREFERRED EMBODIMENT

Figure 1:
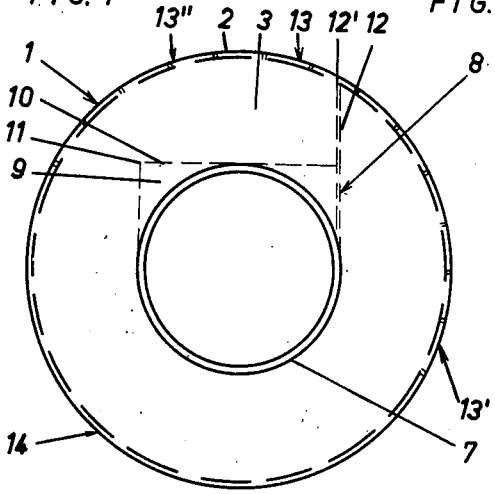
FIG. 1 is a schematic elevational end view of a drum structured according to a preferred embodiment of the invention.
Figure 2:
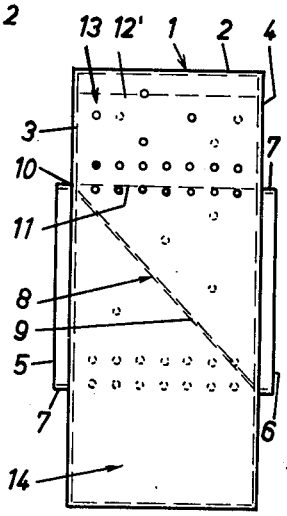
FIG. 2 is a side elevational view of the structure illustrated in FIG. 1.

Turning now to FIGS. 1 and 2, there is shown a drum 1 of an otherwise conventional, drum-equipped apparatus for the wet treatment of textiles, particularly for washing the same. It is to be understood, however, that the term "wet treatment" is not intended to be limited to washing processes, it may include such treatments as cleaning, dyeing or the like.

The drum 1 is formed of a drum shell 2 which is closed at both ends by radial end walls 3 and 4, respectively, to thus obtain a generally closed inner drum space. The end wall 3 has a central inlet opening 5, while the end wall 4 has a central outlet opening 6. Both openings 5 and 6 are surrounded by a respective ring 7. In other aspects too, the end walls 3 and 4 with their respective inlet and outlet openings 5 and 6 are of identical configuration. In the inner space of the drum there is secured a conveying impeller or vane 8 for moving the batches. The impeller 8 is formed of an obliquely oriented slide 9 which, in the position of the drum as shown in FIGS. 1 and 2, extends downwardly from the upper edge of the inlet opening 5 (where it is attached to the end wall 3 along the linear edge 10) to the end wall 4 and which has the shape of a gradually downwardly deepening, upwardly open channel. The slide 9 is surrounded along its lower circumferential half (as viewed in the position depicted in FIG. 2) by the outlet opening 6 and extends linearly upwardly to the diametral height of the outlet opening 6. In this manner there is obtained, at one side, an edge 11 which extends parallel to the drum axis between the two end walls 3 and 4. On the other side, this upwardly extending wall of the impeller slide 9 is extended up to the junction 12' with the drum shell 2 and thus forms a lifting wall 12 which merges with a gradual transition, in the impeller slide 9.

The drum shell 2 has an apertured zone 13 and a non-apertured (that is, aperture-free) zone 14. Each zone 13 and 14 extends in the circumferential direction approximately along one-half of the drum circumference. The apertured zone 13 is situated on that part of the drum shell which is oriented towards the work face (slide face) of the slide 9, while the aperture-free zone 14 is oriented towards the backside (reverse side) of the slide 9. The junction edge 12' of the lifting wall 12 at the drum shell 2 extends axially parallel, at least approximately in the middle of the apertured zone 13, thus dividing the latter into an apertured part zone 13' and an apertured part zone 13" arranged on either side of the lifting wall 12. The two end walls 3 and 4 are, at least in the aperture-free zone 14, connected in the liquidtight manner (for example, by welding) with the drum shell 2. Further, the inner face of the drum shell 2 is smooth, that is, it has no ribs or other protrusions.

The operation of the drum 1 will now be described with reference to FIGS. 3, 4, 5 and 6.

Figure 3:
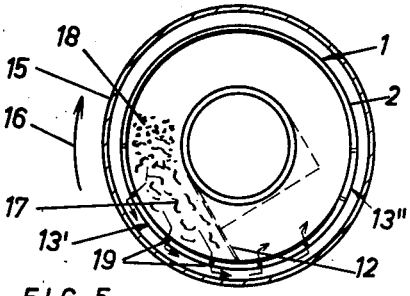
FIGS. 3, 4 and 5 are elevational end views, on a reduced scale, of the preferred embodiment, showing the same in different angular positions during the treating phase.
Figure 4:
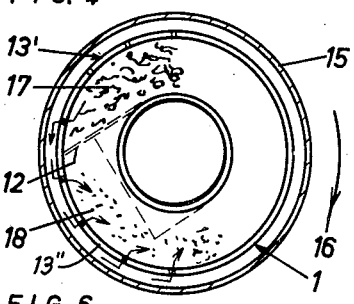
Figure 5:
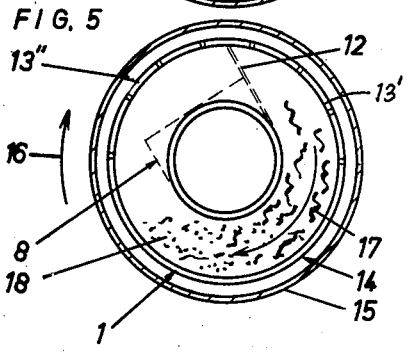

The drum 1 is supported in a stationary outer vessel 15 and is partially submerged into the treating liquid 18. Supply and discharge conduits as well as heating devices (neither shown) serve for maintaining the liquid 18 in its desired effective condition. During the wet treatment (such as washing) of a batch 17, the drum 1 rotates clockwise in the direction of the arrow 16. When the lifting wall 12 reaches its lowermost position as shown in FIG. 3, the entire batch 17 is held together in the wedge-shaped space between a portion of the drum shell 2 and the lifting wall 12. In this position of the drum, the liquid 18 still dwelling on the batch 17 flows through the batch 17 downwardly and, passing through the holes 19 of the apertured part zone 13', flows into the space between the outer vessel 15 and the drum shell 2. In that space the liquid then flows past the junction 12' and flows back into the drum 1 through the holes 19 of the other apertured part zone 13". During the course of further rotation in the treating direction 16, the batch 17 is moved upwardly by the lifting wall 12, as depicted in FIG. 4. During the entire batch lifting step, the liquid 18 flows out of the drum through the openings 19 of the part zone 13' and then flows back into the drum 1 through the holes 19 of the other part zone 13" as shown by the arrows drawn through the openings 19 in FIG. 4. In this manner liquid is continuously drawn from the batch 17. Upon further clockwise rotation, as the inclination of the lifting wall 12 increases, the batch 17 slides and falls downwardly into the liquid 18 which has accumulated in the drum 1 above the aperture-free zone 14 which, by this time, has assumed its lower position as shown in FIG. 5. By means of the impact speed of the batch 17 with which it splashes into the stationary liquid 18 and by virtue of the circumstance that the liquid 18 can be displaced neither upwardly because of the impeller slide 9 nor downwardly because of the non-apertured zone 14, an intensive liquid penetration is achieved. This liquid penetration is further enhanced by the sinking leading portion of the apertured part zone 13'. In this manner, by means of the then occurring exit of the liquid 18, a drop in the liquid level and thus an intensive penetration of the batch 17 is maintained. Upon further rotation in the treating direction 16, the drum 1 again assumes its position shown in FIG. 3 and the cycle is repeated.

Figure 6:
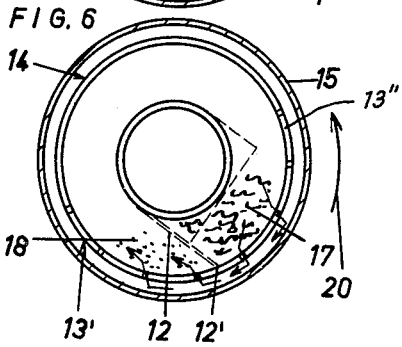
FIG. 6 is an elevational end view of the same embodiment illustrating the same during the conveying phase.

Upon termination of the treating phase, the conveying phase begins, for which the drum 1 is rotated in the opposite, "conveying" direction as indicated with the arrow 20 in FIG. 6. During this counterclockwise rotation, first the lifting wall 12 engages the batch 17, whereby the liquid 18 flows through the bores 19 of the apertured part zone 13" out of the drum 1 and onto the outer vessel 15 and then, passing the junction 12', it flows again back into the drum 1 through the bores 19 of the other apertured part zone 13'. Thus, during the subsequent lifting of the batch 17 by the lifting wall 12, a substantial part of the liquid 18 is withdrawn from the batch. This liquid remains in the drum 1 or, as the case may be, in the outer vessel 15 while the batch 17 is further lifted. As, during the rotation of the drum 1 in the conveying direction 20, the wall 12 attains a sufficient inclination, the batch 17 slides on the lifting wall 12 downwardly onto the impeller slide 9 and further slides on the latter in the conveying direction from the left to the right as viewed in FIG. 2, to thus exit through the outlet opening 6 and to be then introduced into the successive drum 1.

Figure 7:
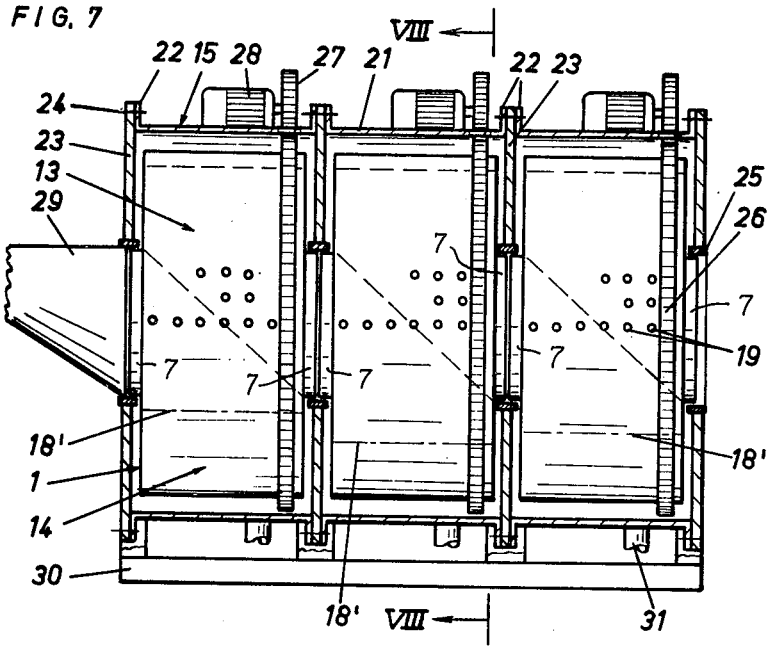
FIG. 7 is a sectional side elevational view of an apparatus incorporating a plurality of drums structured according to the invention.

Turning now to FIG. 7, there is illustrated therein a drum-equipped washing machine in which the drums are structured according to the invention. The washing machine has three drums 1. The outer vessels 15 are formed of a housing portion 21 which, at its opposite ends, is provided with radially outwardly extending annular flanges 22. To these flanges there are secured, by means of bolts 24 or the like, radial separating walls 23 in a fluidtight manner. The housing shell 21 of an adjoining outer vessel 15 may engage directly the opposite side of the separating wall 23, so that, in each instance, only a single separating wall 23 is arranged between any two adjoining drums 1. Each separating wall 23 is provided with a central opening accommodating a slide bearing ring 25 which surrounds and supports two adjoining rings 7 belonging, respectively, to the outlet opening 6 of one drum 1 and the inlet opening 5 of the adjoining, successive drum 1. Each drum 1 is provided with a gear ring 26 arranged circumferentially on the outside of the respective drum shell 2. Each gear ring 26 meshes with a respective pinion 27 of a reversible drive motor 28 supported externally of the respective outer vessel 15. It may be observed in FIG. 7 that each drum 1 can be rotated, during operation, either in the treating direction or in the conveying direction. The batches which are introduced into the machine through a hopper 29 arranged at the left side of the machine (as viewed in FIG. 7) are thus, after each washing phase, conveyed towards the right into the successive drum and thus batchwise leave the last drum 1 situated at the right. For supporting the outer vessels 15 there is provided a machine frame 30. The supply and control of wash detergents and additives as well as the supply and control of heat for the liquid 18 are effected in a conventional manner. Also, at the same time, the liquid quantity is controlled as indicated at 18' showing non-uniform liquid levels in the several drums 1.

Figure 8:
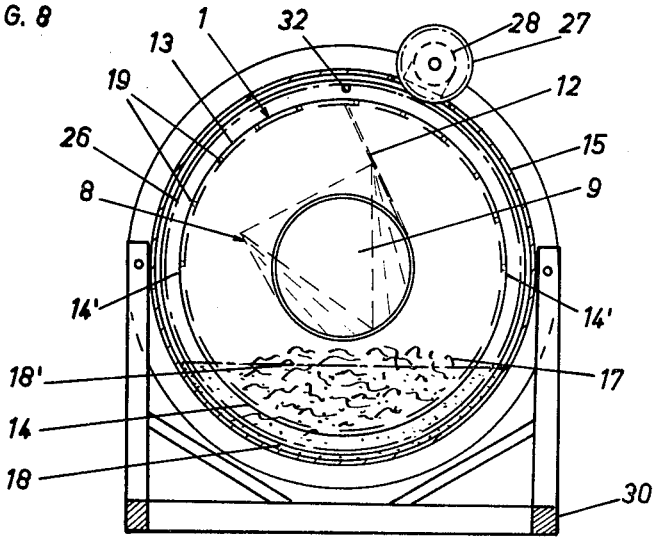
FIG. 8 is a sectional view taken along line VIII—VIII of FIG. 7.

When the washing machine is switched off, a control arrangement in the drum drive ensures that the drums 1 come to rest in a "parking" position in which the two ends 14' of the aperture-free zone 14 are situated above a horizontal plane that corresponds to the normal operational liquid level 18', while the remainder of the zone 14 is underneth that plane, as indicated in FIG. 8. Stated differently, in the "parking" position the lower circumferential half of the drum shell is its aperture-free zone 14 and the liquid level 18' is such that it does not project beyond the aperture-free zone 14 into the apertured zone 13. In this manner, underneath the ends 14' there is provided a liquidtight space inside the drum 1 so that liquid can flow neither out of the drum nor thereinto when the machine is at standstill. Thus, at standstill, the condition of the liquid 18 and the batch 17 present in the drum 1 is, apart from changes in temperature, maintained constant irrespective of the time lapsed. The control arrangement for achieving such a predetermined parking position includes known elements, for example, a contact 32 which is mounted on the gear ring 26 and the position of which is sensed by contacting or contactless means to achieve a predetermined parking position subsequent to to the shutoff of the washing machine.

It is to be understood that the distribution of the apertured and aperture-free zones 13 and 14, respectively, may be different from that disclosed above, but should be so designed that the opposite ends 14' of the aperture-free zone 14 project upwardly beyond the horizontal plane representing the liquid level 18' in the position of rest (parking position) of the drum 1. Thus, it is feasible to provide different distributions of the zones 13 and 14 from drum to drum to thus adopt the liquid penetration to the particular treating phase. It is further feasible to provide a single drive for all drums 1 of the drum-equipped apparatus, for example, by providing, for the pinions 27, a throughgoing common shaft driven by a single motor. In such a case, the conveying positions of the drums 1 are expediently angularly staggered with respect to one another, while care is taken that in the parking position the drums 1 are separated liquidtight from one another as described above.

It is to be understood that the above description of the present invention is susceptible to various modifications, changes and adaptations and the same are intended to be comprehended within the meaning and range of equivalents of the appended claims.

What is claimed is:

1. In a drum-equipped apparatus for the wet treatment of batches of material, having a horizontally oriented, rotatably supported drum including a drum shell bounded by end walls and including a central inlet opening and a central outlet opening provided in the one and the other end wall, respectively; means for selectively rotating the drum in a treating direction and in an opposite, conveying direction; a lifting wall affixed to the drum in the inside thereof for displacing the material batch radially with respect to the rotary axis of the drum during the rotation thereof in the treating direction; a slide affixed to the drum in the inside thereof for conveying the material batch in the axial direction of the drum towards the outlet opening during the rotation thereof in the conveying direction; the slide having a slide face and a reverse side; an external vessel for receiving treating liquid and accommodating the drum for partial submersion in the treating liquid; the improvement wherein said drum shell has an apertured zone oriented towards said slide face of said slide and an aperture-free zone oriented towards said reverse side of said slide; the improvement further comprising means for rotating said drum into a predetermined parking position after the apparatus is switched off; the circumferential length of said aperture-free zone being such that the circumferentially opposite ends of said aperture-free zone are, in said parking position of said drum, situated above a horizontal plane corresponding to the normal operational level of the treating liquid in said drum.

2. In a drum-equipped apparatus for the wet treatment of batches of material, having a horizontally oriented, rotatably supported drum including a drum shell bounded by end walls and including a central inlet opening and a central outlet opening provided in the one and the other end wall, respectively; means for selectively rotating the drum in a treating direction and in an opposite, conveying direction; a lifting wall affixed to the drum in the inside thereof for displacing the material batch radially with respect to the rotary axis of the drum during the rotation thereof in the treating direction; a slide affixed to the drum in the inside thereof for conveying the material batch in the axial direction of the drum towards the outlet opening during the rotation thereof in the conveying direction; the slide having a slide face and a reverse side; an external vessel for receiving treating liquid and accommodating the drum for partial submersion in the treating liquid; the improvement wherein said drum shell has an apertured zone oriented towards said slide face of said slide and an aperture-free zone oriented towards said reverse side of said slide; and further wherein said lifting wall engages said drum shell along a junction edge extending generally parallel to the drum axis; one part of said apertured zone being situated between said junction edge and one end of said aperture-free zone.

3. A drum-equipped apparatus as defined in claim 2, wherein said aperture-free zone extends about one-half the circumference of said drum shell.

4. A drum-equipped apparatus as defined in claim 2, wherein the other part of said apertured zone is situated between said junction edge and the other, circumferentially opposite end of said aperture-free zone.

5. A drum-equipped apparatus as defined in claim 2, wherein said drum shell has an inner face which is smooth and free from protuberances.

6. A drum-equipped apparatus as defined in claim 2, further comprising means for rotating said drum into a predetermined parking position after the apparatus is switched off; said slide being in the conveying position when said drum is in said parking position.

7. A drum-equipped apparatus as defined in claim 2, wherein each said end wall is attached liquidtight to said drum shell in the aperture-free zone thereof.

8. A drum-equipped apparatus as defined in claim 2, wherein there are provided a plurality of drums supported in an axially aligned series; each said drum being arranged in respective separate closed external vessels.

9. In a drum-equipped apparatus for the wet treatment of batches of material, having a horizontally oriented, rotatably supported drum including a drum shell bounded by end walls and including a central inlet opening and a central outlet opening provided in the one and the other end wall, respectively; means for selectively rotating the drum in a treating direction and in an opposite, conveying direction; a lifting wall affixed to the drum in the inside thereof for displacing the material batch radially with respect to the rotary axis of the drum during the rotation thereof in the treating direction; a slide affixed to the drum in the inside thereof for conveying the material batch in the axial direction of the drum towards the outlet opening during the rotation thereof in the conveying direction; the slide having a slide face and a reverse side; an external vessel for receiving treating liquid and accommodating the drum for partial submersion in the treating liquid; the improvement wherein said drum shell has an apertured zone oriented towards said slide face of said slide and an aperture-free zone oriented towards said revrse side of said slide; and further wherein said lifting wall engages said drum shell along a junction edge extending generally parallel to the drum axis; said junction edge further extending approximately through the middle of said aperture-free zone when viewed circumferentially.

* * * * *